US007694944B2

(12) United States Patent
Gottlieb et al.

(10) Patent No.: US 7,694,944 B2
(45) Date of Patent: Apr. 13, 2010

(54) NOZZLE FOR ATOMISING A LIQUID BY MEANS OF A GAS AND METHOD OF ATOMISING

(75) Inventors: Niels Gottlieb, Virum (DK); Per Bo Sørensen, Copenhagen (DK); Heinz Wullschleger, Herlev (DK)

(73) Assignee: Niro A/S, Soborg (DK)

( * ) Notice: Subject to any disclaimer, the term of this patent is extended or adjusted under 35 U.S.C. 154(b) by 768 days.

(21) Appl. No.: 10/596,265

(22) PCT Filed: Dec. 22, 2003

(86) PCT No.: PCT/DK03/00929

§ 371 (c)(1),
(2), (4) Date: Jun. 16, 2006

(87) PCT Pub. No.: WO2005/061119

PCT Pub. Date: Jul. 7, 2005

(65) Prior Publication Data

US 2007/0164459 A1 Jul. 19, 2007

(51) Int. Cl.
*B01F 3/04* (2006.01)

(52) U.S. Cl. ..... 261/78.2; 261/79.2

(58) Field of Classification Search ..... 261/78.2, 261/79.2, 116, DIG. 75
See application file for complete search history.

(56) References Cited

U.S. PATENT DOCUMENTS

| | | | | |
|---|---|---|---|---|
| 2,612,405 | A | 9/1952 | Kirschbaum | |
| 3,533,558 | A | 10/1970 | Masters | |
| 3,747,851 | A * | 7/1973 | Conrad | 239/8 |
| 3,977,608 | A | 8/1976 | Bullock | |
| 4,175,706 | A * | 11/1979 | Gerstmann | 239/414 |
| 5,232,164 | A * | 8/1993 | Resch et al. | 239/434 |
| 5,848,750 | A * | 12/1998 | Schwab | 239/405 |
| 6,142,388 | A | 11/2000 | Schwab | |

* cited by examiner

*Primary Examiner*—Scott Bushey
(74) *Attorney, Agent, or Firm*—Sughrue Mion, PLLC

(57) ABSTRACT

A nozzle for atomizing a liquid using a gas. The nozzle includes a mixing chamber (1), one or more liquid inlets (6*c*) and at least one tangential gas inlet (5) to the mixing chamber. An outlet (4) is positioned at the downstream end of the mixing chamber (1). A center body (2) having a generally converging configuration, seen in the flow direction, is provided in the mixing chamber (1). The liquid inlet (6*c*) or inlets is/are positioned at or near the upstream end (3*a*) of the mixing chamber (1) and in the upstream direction with respect to the gas inlet (5) or inlets.

13 Claims, 4 Drawing Sheets

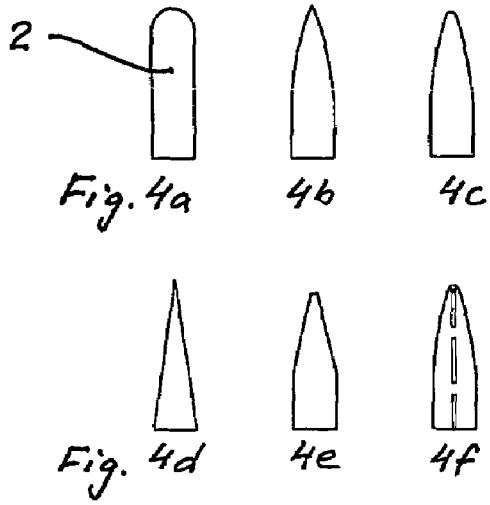
2
Fig. 4a
4b
4c
Fig. 4d
4e
4f
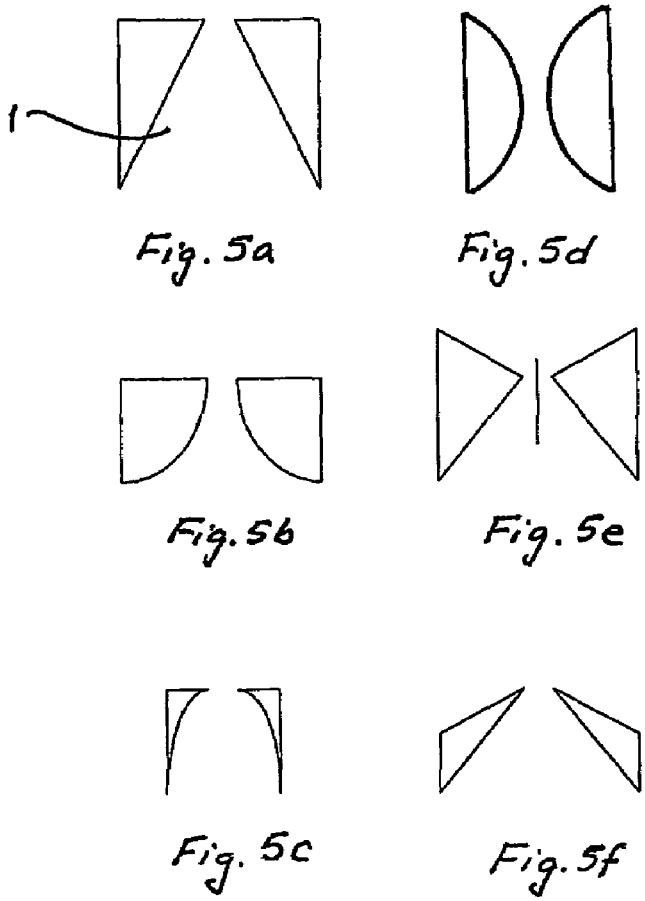
1
Fig. 5a
Fig. 5d
Fig. 5b
Fig. 5e
Fig. 5c
Fig. 5f

NOZZLE FOR ATOMISING A LIQUID BY MEANS OF A GAS AND METHOD OF ATOMISING

FIELD OF THE INVENTION

The present invention relates to a nozzle for atomising a liquid by means of a gas, comprising a mixing chamber extending between an upstream end and a downstream end, at least one liquid inlet and at least one tangential gas inlet to said mixing chamber, and an outlet positioned at the downstream end of said mixing chamber. The invention furthermore relates to a method of atomising a liquid by means of a gas.

BACKGROUND OF THE INVENTION

Such nozzles, which are usually denoted two-fluid nozzles (TFN), are i.a. used for atomisation of a liquid in spray drying plants and in fluid bed agglomeration. Liquids can be in the form of solutions, dispersion or pure substances.

In particular, two-fluid nozzles are used when atomising a fluid, where fine droplets is the objective or where additional atomisation energy in the form of atomising gas is required to break up a fluid into droplets.

The mixing of the liquid and the gas may take place either inside the nozzle itself, so-called internal mixing, or outside the nozzle outlet, so-called external mixing.

With external mixing TFN, the free expansion of the gas has the disadvantage of being partly lost to the surrounding instead of adding energy to break up the liquid.

Internal mixing TFN has the advantage, compared to external mixing TFN, to mix gas and liquid before the two fluids enter the surrounding atmosphere through the outlet.

Criterions for evaluating the performance of a two-fluid nozzle are: the mean droplet size, the span of the droplet size distribution and not least the specific gas consumption, meaning the amount of gas used to atomise a given amount of liquid, also called the gas-to-feed ratio.

Atomizing finer droplets with a certain two-fluid nozzle means in general higher specific gas consumption. The specific gas consumption varies with type and size of two-fluid nozzle. In general, ratios between 1 and 2 (two gas-rate units to one feed-rate unit) are used. Rate is mass pr. time. The gas may be air, nitrogen, carbon dioxide, or any other suitable gas.

The span expresses how wide the droplet size distribution is. Aiming at a specific droplet size, a narrow distribution is desired. A wide distribution of the droplet size is generally disadvantageous.

The span, evaluated as (d90−d10)/d50 is normally found in the range from 1 to 3 for the type of nozzle in question and depending on the feed rate.

The contact and mixing of gas and liquid is where TFN meet their restrictions.

External mixing TFN, where the gas typically mixes with the liquid after leaving the nozzle through a ring-shaped aperture, meets the limitation when the gap in the gas exit becomes so large that a larger part of the gas is lost into the surrounding atmosphere, instead of reacting with the liquid.

Atomization into fine droplets follows when the liquid is spread out as a film, acting with the atomisation gas at high relative velocity to form droplets.

Internal mixing nozzles give the possibility of an efficient liquid-gas reaction, but is limited in capacity by internal channeling and channel dimensions.

Internal parts in the nozzle, intended for improving the gas-liquid mixing, also disturb the flow, causing the span of the droplet size distribution to rise. Internal parts in general complicate handling, cleaning and causes wear.

Addition of atomisation gas influences the spray drying or spray cooling process, in general causing a delay in the reaction following the atomisation.

Examples of nozzles of the internal-mixing type are well known in the art.

U.S. Pat. No. 2,612,405 discloses a nozzle in which the gas is supplied in the axial direction of the nozzle. Inside the gas supply pipe a drying air pipe and a guiding device is provided. The guiding device imparts a tangential deflection of the gas. The liquid is supplied in a pipe extending radically outside the gas pipe.

In a commercially available nozzle the atomising gas is supplied tangentially in a separate pipe, which contributes to the radial dimensions of the nozzle. Furthermore, the mixing chamber of this prior nozzle comprises edges and obstructions resulting from structural conditions.

International published application No. WO 00/58014 discloses a sprayer in the form of a nozzle having a tangential gas inlet to the mixing chamber and lateral liquid inlets. This nozzle suffers from insufficient mixing due to the geometry of the nozzle.

SUMMARY OF THE INVENTION

With this background it is an object of the present invention to improve a nozzle of kind mentioned in the introduction with respect to the specific gas consumption, which is necessary in order to provide a certain demanded mean droplet size, and with a state-of-the-art span of the droplet size.

In a first aspect of the invention, this object is met by a nozzle of the kind mentioned in the introduction, which is furthermore characterized in that a centre body having a generally converging configuration, seen in the flow direction, is provided in the mixing chamber, and that said at least one liquid inlet is positioned at or near the upstream end of said mixing chamber and in the upstream direction with respect to said at least one gas inlet.

With this design of the nozzle, it has proven possible to obtain a more efficient atomisation. In the prior art nozzles, the production of fine particles in spray drying applications takes place by atomising the liquid feed with a very low content of solid material. With the nozzle according to the invention, higher solids content in the liquid will be permitted for production of a specified low mean particle size, thereby raising the production capacity for an atomising device. However, the nozzle according to the invention is also advantageous when atomising feeds having a low solids content. Further, the large liquid capacities, which follows from the low specific gas consumption, makes it possible to be used in plants with larger capacity. In addition, a narrow span of the droplet size has been achieved. The generally converging configuration is particularly advantageous, as it is possible to obtain a very satisfactory mixing and acceleration of the gas-liquid mixture in the nozzle. This type of nozzle is particularly advantageous for fine particles, i.e. particles having d_50 in the lower range of the intervals 1-10 μm (e.g. for inhalation) and 10-20 μm, and is also useful in the interval 20-50 μm. One example is manufacturing of pharmaceuticals for inhalation and/or manufacturing of active pharmaceutical ingredients (API).

In a structurally simple development of the preferred embodiment, which furthermore makes it possible to obtain a mixing portion and an accelerating portion in the mixing chamber, the centre body comprises a cylindrical base portion and a converging portion.

preferably, the downstream end of said centre body is positioned outside the outlet of the nozzle. This provides for a well-defined point of separation of the gas-liquid mixture flow from the nozzle.

The mixing chamber may comprise a cylindrical portion and a converging portion, said at least one gas inlet being provided in the cylindrical portion. The convergent part of the swirl mixing chamber has the function of accelerating the gas-liquid mixture up to is maximum speed at the outlet of the nozzle, typically the speed of sound. Here, at the outlet, the final, well-defined fine atomisation takes place.

Preferably, the mixing chamber is provided in a chamber part. This design makes it possible to obtain various shapes of the mixing chamber simply by varying the geometry of the chamber part.

In a preferred embodiment, the centre body forms an integral part of an insert. This provides for easy manufacture and assembly of the nozzle. Furthermore, this design entails that there is no need for supports for the centre body in the outlet, and the gas-liquid mixture may thus pass unobstructed through the outlet.

In a development of this preferred embodiment, the insert comprises a disk portion positioned at the upstream end of the centre body, said disk portion forming at its downstream face the upstream end of said mixing chamber.

In a further development of this preferred embodiment, the insert at its upstream end is connected with a bottom part, which in turn is connected with a cap part, said chamber part being positioned within said cap part and in connection with said insert. The particularly simple design, which allows for easy assembly and dismounting, facilitates cleaning and inspection which is essential to e.g. pharmaceutical production. Furthermore, the simple construction makes it possible to scale the nozzle to both small and large sizes.

It has proven particularly advantageous to provide only one gas inlet extending tangentially with respect to the inner circumference of the mixing chamber.

In an embodiment, which is particularly advantageous with respect to design, the centre body is adjustable in the axial direction. The possibility of adjusting the outlet cross sectional area by displacing the centre body in the axial direction is an important parameter when designing a specific nozzle size and specific gas rate. Design of outlet area by adjusting the gap between centre body and mixing chamber can for a specific nozzle be adjusted to a certain gas-range, say 2 to 4 up to 50 to 100 kg per. hour. It may also be possible to adjust standard nozzles, e.g. with a view to obtaining a more narrow span of the particle size.

In a second aspect of the invention, a method of atomising a liquid by means of a gas is provided, in which the area of the gap defined between the inner periphery of the outlet and the centre body is designed and a gas pressure chosen so that two sonic jumps takes place during operation, a first jump taking place when the gas enters the mixing chamber, and a second jump when the gas-liquid mixture leaves through the outlet gap.

Beyond spray drying, the method may also be a spray cooling (congealing) method where it is essential that the liquid feed is kept warm all through the interior of the atomising nozzle. As the gas for atomisation is introduced downstream of the liquid, the hot gas surrounds the mixing chamber in the plenum chamber, and the risk of solidification inside the nozzle is minimised. Also more expensive systems of heating e.g. by means of hot oil can be avoided. Spray cooling may be used for e.g. waxes and waxy solids such as e.g. glycerol esters of fatty acids. An example is spray cooling of wax resulting in particles having d_50 of <3 μm, and d_90<10 μm, and having a span of approx. 3. The nozzle may also be advantageously used for agglomeration, e.g. fluid bed agglomeration, spray coating for e.g. coating pellets, tablets or small items.

In the following the invention will be described in further detail by means of an embodiment thereof and the appended drawings.

BRIEF DESCRIPTION OF THE DRAWINGS

FIGS. 4*a* to 4*f* are schematic views illustrating different shapes of the centre body of the nozzle according to the invention, FIGS. 5*a* to 5*f* are schematic views illustrating different shapes of the mixing chamber of the nozzle according to the invention.

DESCRIPTION OF PREFERRED EMBODIMENTS

Figure 1:
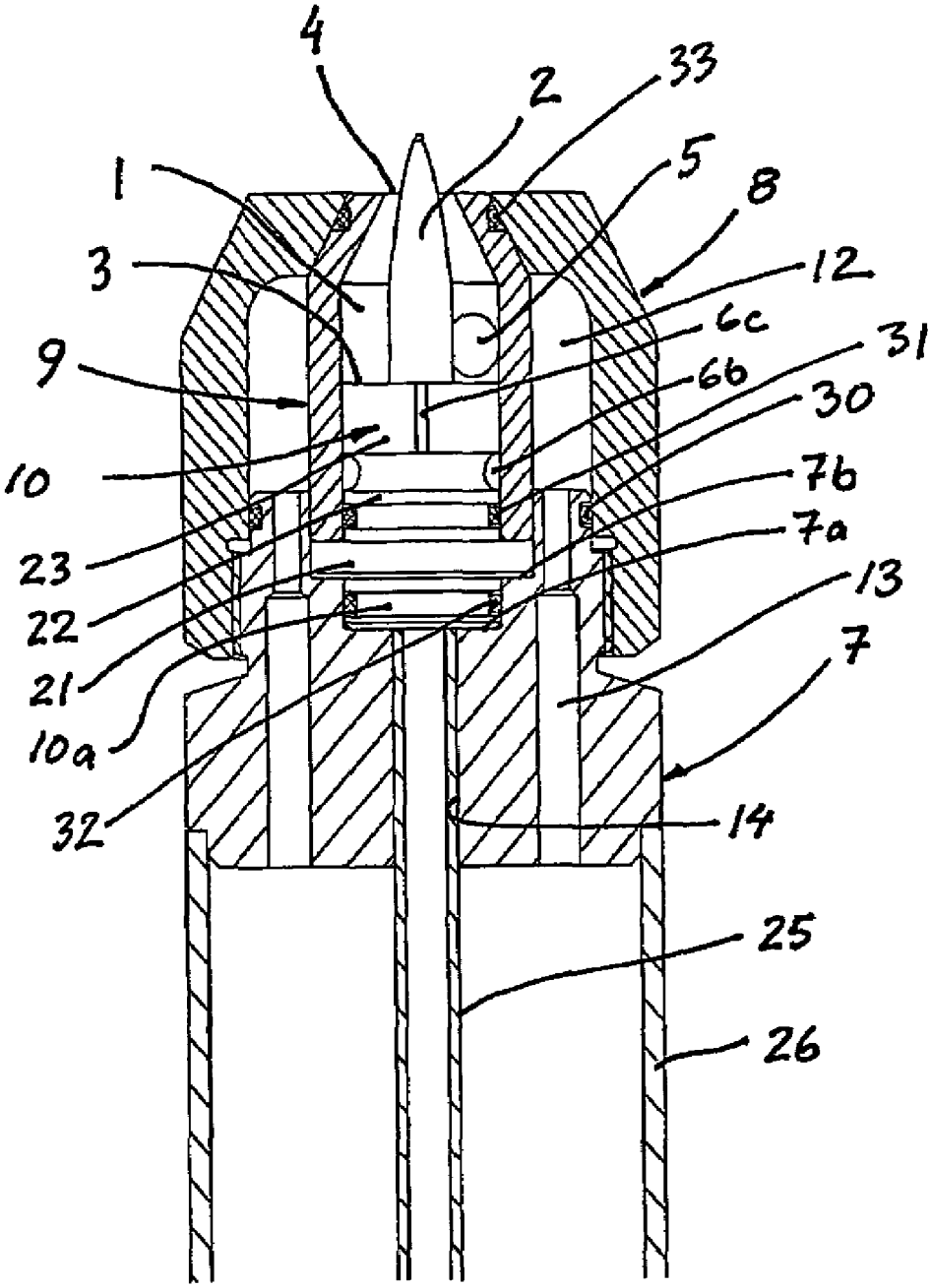
FIG. 1 is a sectional view of a nozzle in an embodiment of the present invention.

In the embodiment of the two-fluid nozzle shown in a sectional view in FIG. 1, the main components of the nozzle comprise a bottom part 7, a cap part 8, a chamber part 9 and an insert 10 with a centre body 2. The direction of flow in the nozzle generally extends from an upstream end at the bottom part 7 to a downstream end at an outlet 4 at the respective ends of the cap part 8, the chamber part 9 and the insert 10 opposite the bottom part 7.

The bottom part 7 is at the upstream end of the nozzle e.g. connected to a nozzle-lance having a central liquid supply. In the embodiment shown, the liquid supply pipe 25 is attached into the bottom part 7 by means of a thread (not shown in detail) into a central bore 14 in the bottom part 7. Optionally, an O-ring seal may be provided. The bottom part 7 is furthermore connected with an external tube 26, which together with the liquid supply pipe 25 forms a space in which the gas is transferred from an inlet (not shown) to a number of axial gas channels 13 extending through the bottom part 7. At the downstream end of the central bore 14, a first shoulder portion 7*a* is provided, and further downstream a second shoulder portion 7*b*, the second shoulder portion 7*b* extending outwards in the radial direction with respect to the first shoulder portion 7*a*. The first and second shoulder portions 7*a*, 7*b* accommodate the upstream end of the insert 10 and partly of the chamber part 9 in a manner that will be described in further detail in the following. On the radial outwards side, the bottom part 7 is connected with the cap part 8 by means of a thread and an O-ring seal 30.

The insert 10 has an upstream end 10*a* which is accommodated in the bottom part 7 and abuts against the first shoulder portion 7*a*. A first disk portion 21 abuts against the second shoulder portion 7*b* of the bottom part 7. The dimensions of the disk portion 21 are such that the disk portion 21 has the largest diameter of the insert 10. This feature makes it possible for the chamber part 9 to hold the insert 10 in place in the bottom part 7 by transferring the force from the cap part 8 to counteract the liquid pressure. Further downstream of the insert 10, a second 22 and a third disk portion 23 are provided.

The outer dimensions of the second and third disk portions 22, 23 correspond substantially to the inner dimensions of the upstream end of the chamber part 9. The centre body 2 of the insert extends from the downstream face 3 of the third disk portion 23. The space between the downstream face 3, the centre body 2 and the inner wall of the chamber part 9 downstream of the third disk portion 23 constitutes a mixing or swirl-mixing chamber 1. The centre body 2 is rotationally symmetrical in the mixing chamber 1, extending from an upstream or bottom end formed by the downstream face 3 to the outlet 4 or out through the outlet. In the embodiment shown, the centre body 2 has a generally converging shape seen in the direction of flow, and comprises a cylindrical portion 2*a* and a converging portion 2*b* (cf. FIG. 2). Alternative shapes of the centre body 2 will be described in further detail below.

A central bore (not shown) in the insert 10 is coaxial with the central bore 14 in the bottom part 7. At the downstream end of the central bore, a number of radically extending bores 6*a* are provided. In the embodiment shown, two bores 6*a* are provided, of which one is visible in FIG. 2. The radically extending bores 6*a* are in fluid communication with an annular channel 6*b* formed between the second and third disk portions 22, 23 and the inner wall of the chamber part 9. The third disk portion 23 comprises a number of axially extending recesses which constitute axially extending channels 6*c* extending from the annular channel 6*b* to the downstream face 3 of the third disk portion 23 and thus to the swirl-mixing chamber 1.

The chamber part 9 is positioned coaxially with respect to the insert 10 and the cap part 8. The outer wall of the chamber part 9, together with the inside wall of the cap part 8, forms a gas plenum chamber 12. The interior of the chamber part 9 is a rotationally symmetric geometry, constituted. by a cylindrical portion and a converging portion closest to the outlet 4. In combination with the shape of the centre body 2, this geometry results in that the mixing chamber 1 has a cylindrical portion and a converging portion. Alternative shapes of the mixing chamber 1 will be described in further detail below. The chamber part 9 contains one or more gas inlet channels 5. In the embodiment shown, there is one gas inlet 5 extending substantially tangentially with respect to the inner wall of the chamber part 9.

Together, the chamber part 9 and the insert 10 form a unit, fitting into the bottom-cap system. This gives an advantage when handling the nozzle regarding pre-assembly of the nozzle parts and the possibility of easily replacing worn parts. The two pieces are sealed and held together by an axially sealing O-ring 31. This sealing prevents gas from entering the swirl-mixing chamber 1 from bottom, i.e. the downstream face 3 of the disk 23, of the chamber 1. Further O-rings 32,33 are used to seal the liquid system from the gas system and to seal the gas plenum chamber 12 from the surrounding atmosphere.

In the following, the operation of the nozzle will be explained. The gas for atomisation enters the gas plenum chamber 12 through the axial gas channels 13. From the plenum chamber 12 the gas is accelerated through the gas inlet 5, into the swirl mixing chamber 1 in a tangential direction to the cylindrical chamber inner wall. The tangential inflow of gas creates a swirling flow field in the mixing chamber around the centre body. Although tangential gas supply to the mixing chamber traditionally implies a large diameter of the atomisation nozzle due to channels or piping extending radial from the atomisation nozzle, the present design minimises the nozzle diameter.

The liquid is distributed from the central bore 14 in the bottom part 7 and the central bore in the insert 10 through the bores 6*a* via the circular channel 6*b* to the liquid inlets in the form of the axially extending channels 6*c* placed in the periphery of the disk 23 introducing the liquid in the swirl-mixing chamber 1.

Figure 2:
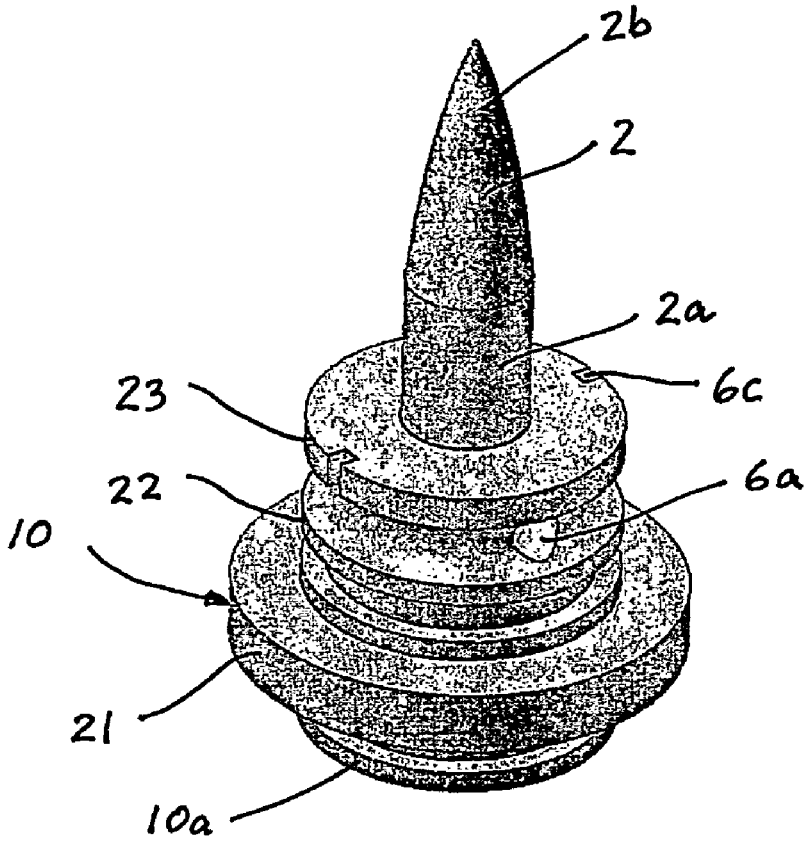
FIG. 2 is a perspective view, on a larger scale, of the insert of the nozzle of FIG. 1.
Figure 3:
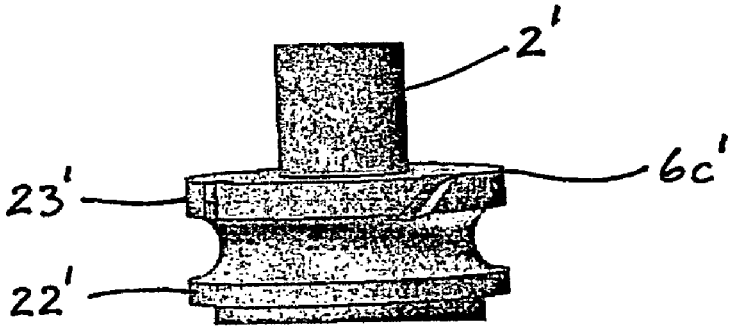
FIG. 3 is a perspective view corresponding to FIG. 2 of the insert in another embodiment of the nozzle according to the invention.

The direction of the liquid inlets can be parallel to the centre axis as indicated in the embodiment of FIGS. 1 and 2, or inclined, as shown in FIG. 3 to give the liquid a swirling motion. In the alternative embodiment of FIG. 3, parts similar to or having an analogous function as corresponding parts in FIGS. 1 and 2 are denoted by the same reference numerals to which has been added. Also, the liquid inlets can have the form of a cylindrical bore extending from the liquid annular channel 6*b* to the bottom of the mixing chamber 1, or have the form of an annular gap, distributing the liquid as a uniform film, when entering the bottom of the swirl-mixing chamber.

When entering the swirl-mixing chamber 1 the liquid is entrained in the gas stream entering from the gas channel 5. The gas-liquid mixture swirls around the centre body 2 and accelerates through the convergent portion of the swirl-mixing chamber 1 leaving to the surrounding atmosphere through the annular outlet 4, where the gas-liquid mixture separates from the nozzle geometry. In the embodiment shown, the separation point (ring) on the centre body 2 can be found outside the chamber outlet.

The convergent portion 2*b* of the centre body can have different forms as shown in FIG. 4. The form can be a half-sphere (FIG. 4*a*), a bullet shape (FIG. 4*b*) ending in a point, the form defined by rotating e.g. a circle arch or parable around the axis of symmetry, or have the form of an ellipsoid (FIG. 4*c*) or simply a cone (FIG. 4*d*). To fix the point of separation, the end point of the centre body 2 can be modified (FIG. 4*e*) to have a plane front end or a dent or hollow formed of curved or conical form, or a channel for adding gas to control the vacuum following the separation point (FIG. 4*f*). The mouth of the channel may have any conceivable shape. The above-mentioned converging forms follow the cylindrical part. The cylindrical part of the centre body can be excluded; the convergent part then extends to the chamber bottom 3.

The function of the centre body 2 is to stabilise the swirling flow and prevent the surrounding atmosphere from flowing into the chamber 1 by filling out the low pressure centre of the swirling flow. Further the centre body creates the inner limitation of the annular outlet 4 thereby enabling the use of a large outlet diameter for a given outlet cross-sectional area. The larger diameter is favorable in the sense of mixing air and gas. The narrower the gap, the better the liquid and gas are brought to react and thereby atomise into fine droplets.

The outlet cross sectional area can be adjusted in the design phase, by extending the axial length of the centre body.

Adjusting the outlet gap 4 between centre body 2 and swirl-mixing chamber 1 is important when a low specific gas consumption is to be obtained. Adjusting the gap also controls the pressure in the swirl-mixing chamber for a given gas and liquid flow rate and is thereby a precondition for obtaining the double sonic jump in the TFN. Adjustment of the gap is preferably done in the design phase of a series of nozzle sizes adapted to specific rates of gas and liquid.

A point of separation of the gas-liquid mixture is found on the centre body 2 close to the rounded head, which is the trailing edge, considering the flow field. A well-defined separation point is essential for the function of the nozzle. The point should preferably be found outside the nozzle, in the sense that a plane, normal to the plane defined by the centre body, intersecting this in the separation circle will not intersect with the nozzle geometry.

The swirling gas flow in the swirl mixing chamber is enhanced by the tangential gas inlet or inlets 5 to the swirl mixing chamber 1, and is furthermore advantageous to the distribution of liquid entering the swirl-mixing chamber 1 through the liquid inlets 14. Creating a thin, equally distributed liquid film forms the basis of fine atomisation with a minimum of specific air consumption.

The converging swirl-mixing chamber 1 can have the principal forms shown in FIGS. 5*a* to 5*f*. For the conical form the apex or top angle can be between 40 and 120°. The front end plane of the nozzle, facing the surrounding atmosphere, can have different angles from 90 to 45° with the axis of the nozzle or be formed as a diverging outlet following the convergent chamber to form a convergent-divergent nozzle to obtain supersonic speed in the outlet.

Proper design of the gas inlet 5 and gas-liquid outlet 4 cross sectional areas gives the possibility of having sonic velocity both in the gas inlet and the gas-liquid outlet. Tests have shown favorable atomisation results when these conditions are obtained.

Test Results

The droplet size distribution atomising water using nitrogen as gas was measured using laser diffraction. The droplet sizes are expressed as the volume percentage of droplets having a diameter less than a certain value. E.g. d_50 means the diameter read on the graphical presentation, where 50% of the volume of droplets have diameters less than d_50.

The span expresses how wide the distribution is. The definition used is span=(d_90−d_10)/d_50 .

Figure 6:
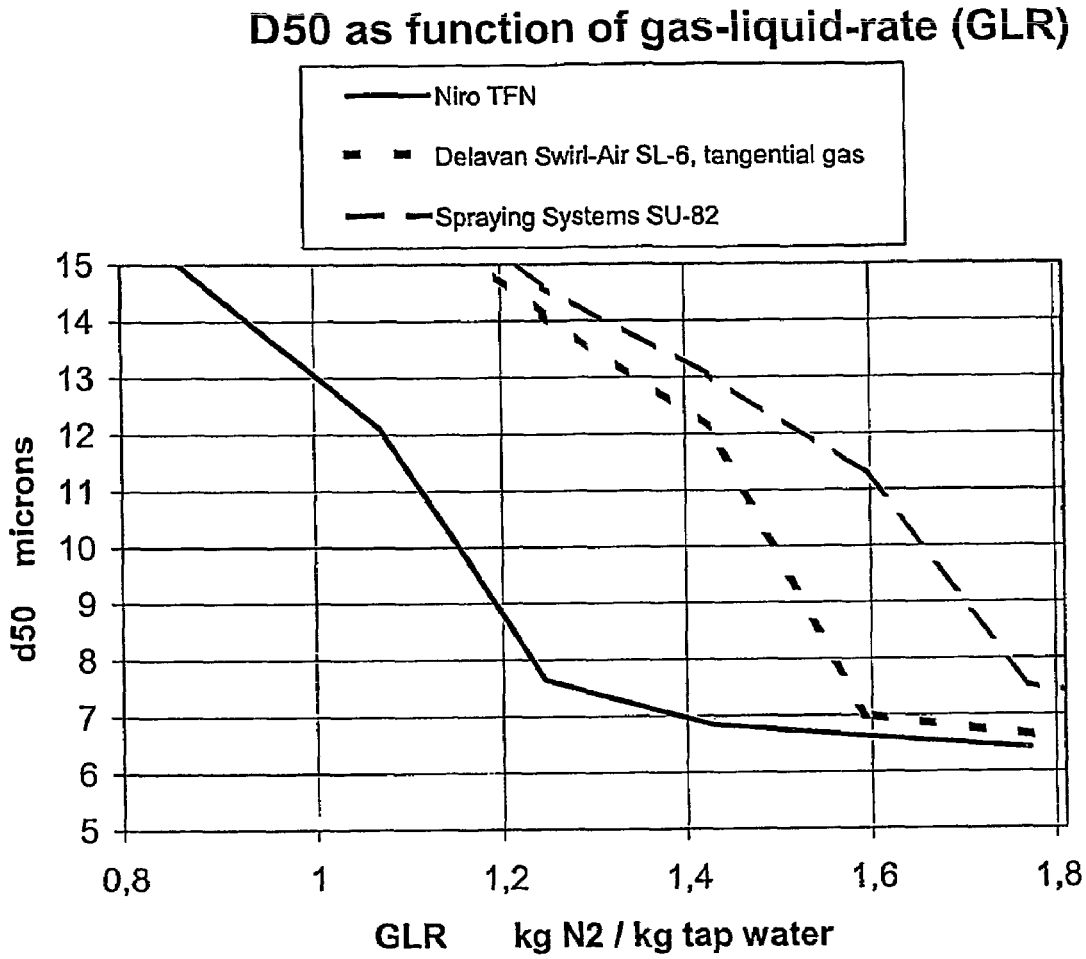
FIG. 6 is a graph showing curves of d_50 as a function of specific gas consumption for different nozzles.

The test results are shown in FIG. 6 where the d_50 is shown as a function of the specific gas consumption, the "gas to feed ratio", for a number of prior art nozzles and for a nozzle according to the invention. The feed rate was 50 kg per hour of tap water. It may be seen that the nozzle according to the invention has a significantly lower specific gas consumption for a given mean particle size.

The invention claimed is:

1. A nozzle for atomising a liquid by means of a gas, comprising:

a mixing chamber (1) extending between an upstream end and a downstream end, at least one liquid inlet (6*c*) and at least one tangential gas inlet (5) to said mixing chamber, and an outlet (4) positioned at the downstream end of said mixing chamber (1), wherein a centre body (2) having a generally converging configuration, seen in the flow direction, is provided in the mixing chamber (1), said centre body being rotationally symmetrical in the mixing chamber and extending from an upstream end to the outlet or out through the outlet, and wherein said at least one liquid inlet (6*c*) is positioned at or near the upstream end (3*a*) of said mixing chamber (1) and in the upstream direction with respect to said at least one gas inlet (5).

2. A nozzle as claimed in claim 1, wherein the centre body (2) comprises a cylindrical base portion (2*a*) and a converging portion (2*b*).

3. A nozzle according to claim 1, wherein the downstream end of said centre body (2) is positioned outside the outlet (4) of the nozzle.

4. A nozzle according to claim 1, wherein the mixing chamber (1) comprises a cylindrical portion and a converging portion, said at least one gas inlet (5) being provided in the cylindrical portion.

5. A nozzle according to claim 1, wherein said mixing chamber (1) is provided in a chamber part (9).

6. A nozzle according to claim 1, wherein the centre body (2) forms an integral part of an insert (10).

7. A nozzle according to claim 6, wherein the insert (10) comprises a disk portion (23) positioned at the upstream end of the centre body (2), said disk portion (23) forming at its downstream face (3) the upstream end of said mixing chamber (1).

8. A nozzle according to claim 6, wherein said insert (10) at its upstream end is connected with a bottom part (7), which in turn is connected with a cap part (8), said chamber part (9) being positioned within said cap part (8) and in connection with said insert (10).

9. A nozzle according to claim 1, wherein one gas inlet (5) is provided tangentially with respect to the inner circumference of the mixing chamber (1).

10. A nozzle according to claim 1, wherein said centre body (2) is adjustable in the axial direction.

11. A nozzle for atomising a liquid by means of a gas, comprising:

a mixing chamber (1) extending between an upstream end and a downstream end, at least one liquid inlet (6*c*) and at least one tangential gas inlet (5) to said mixing chamber, and an outlet (4) positioned at the downstream end of said mixing chamber (1), wherein a centre body (2) having a generally converging configuration, seen in the flow direction, is provided in the mixing chamber (1), wherein said at least one liquid inlet (6*c*) is positioned at or near the upstream end (3*a*) of said mixing chamber (1) and in the upstream direction with respect to said at least one gas inlet (5), and wherein an insert (10) comprises a disk portion (23) positioned at the upstream end of the centre body (2), said disk portion (23) forming at its downstream face (3) the upstream end of said mixing chamber (1).

12. The nozzle according to claim 11, wherein said insert (10) at its upstream end is connected with a bottom part (7), which in turn is connected with a cap part (8), said chamber part (9) being positioned within said cap part (8) and in connection with said insert (10).

13. The nozzle according to claim 1, wherein said at least one liquid inlet is at the periphery of the nozzle.

* * * * *